US007357481B2

(12) United States Patent
Baker

(10) Patent No.: US 7,357,481 B2
(45) Date of Patent: Apr. 15, 2008

(54) DUPLEX PRINTING SYSTEM CAPABLE OF INK REMOVAL

(75) Inventor: Richard Baker, West Lebanon, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 284 days.

(21) Appl. No.: 11/045,963

(22) Filed: Jan. 27, 2005

(65) Prior Publication Data

US 2006/0164463 A1 Jul. 27, 2006

(51) Int. Cl.
*B41J 2/15* (2006.01)
*B41J 2/155* (2006.01)

(52) U.S. Cl. ..... 347/40; 347/42

(58) Field of Classification Search ..... 347/40, 347/42

See application file for complete search history.

(56) References Cited

U.S. PATENT DOCUMENTS 5,376,957 A * 12/1994 Gandy et al. ..... 347/3
5,456,539 A * 10/1995 Wright et al. ..... 400/82
2003/0214554 A1* 11/2003 Tschida ..... 347/42

OTHER PUBLICATIONS

International Search Report and Written Opinion of the International Searching Authority, International Application Serial No. PCT/US2006/003063, Apr. 20, 2007, 5 pp.

* cited by examiner

*Primary Examiner*—Julian D. Huffman
*Assistant Examiner*—Jason S. Uhlenhake
(74) *Attorney, Agent, or Firm*—Fish & Richardson P.C.

(57) ABSTRACT

A fluid ejection system includes a first fluid ejection head comprising a first nozzle plate that includes a first set of fluid ejection nozzles capable of ejecting first fluid drops and a second fluid ejection head comprising a second nozzle plate that includes a second set of fluid ejection nozzles capable of ejecting second fluid drops. The second nozzle plate is substantially opposing to the first nozzle plate. The first set of fluid ejection nozzles are offset from the second set of fluid ejection nozzles.

24 Claims, 6 Drawing Sheets

DUPLEX PRINTING SYSTEM CAPABLE OF INK REMOVAL

TECHNICAL FIELD

This application relates to the field of fluid drop ejection.

BACKGROUND

Ink jet printing is a non-impact method that produces droplets of ink that are deposited on a substrate such as paper or transparent film in response to an electronic digital signal. In various commercial or consumer applications, there is a general need to provide ink jet images that are printed edge-to-edge on both faces of an ink receiver.

Ink jet printing systems generally are of two types: continuous stream and drop-on-demand. In continuous stream ink jet systems, ink is emitted in a continuous stream under pressure through at least one orifice or nozzle. Multiple orifices or nozzles also may be used to increase imaging speed and throughput. The ink is ejected out of orifices and perturbed, causing it to break up into droplets at a fixed distance from the orifice. At the break-up point, the electrically charged ink droplets are passed through an electric field which is controlled and switched on and off in accordance with digital data signals. Charged ink droplets are passed through a controllable electric field, which adjusts the trajectory of each droplet in order to direct it to either a gutter for ink deletion and recirculation or a specific location on a recording medium to create images. The image creation is controlled by electronic signals.

In drop-on-demand systems, a droplet is ejected from an orifice directly to a position on a recording medium by pressure created by, for example, a piezoelectric device, an acoustic device, or a thermal device controlled in accordance with digital data signals. An ink droplet is not generated and ejected through the nozzles of an imaging device unless it is needed to be placed on the recording medium.

SUMMARY

In one aspect, the present inventions relates to a fluid ejection system, comprising:

a first fluid ejection head comprising a first nozzle plate that includes a first set of fluid ejection nozzles capable of ejecting first fluid drops; and a second fluid ejection head comprising a second nozzle plate that includes a second set of fluid ejection nozzles capable of ejecting second fluid drops, wherein the second nozzle plate is substantially opposing to the first nozzle plate and the first set of fluid ejection nozzles are offset from the second set of fluid ejection nozzles.

In another aspect, the present inventions relates to a duplex ink jet printing system, comprising:

a first ink jet print head comprising a first nozzle plate that includes a first set of nozzles capable of ejecting first ink drops;

a second ink jet print head comprising a second nozzle plate that includes a second set of nozzles capable of ejecting second ink drops, wherein the second nozzle plate is substantially opposing to the first nozzle plate and the second set of nozzles in the first nozzle plate offset from the first set of nozzles in the second nozzle plate; and a receiver transport system configured to transport a receiver through a gap between the first nozzle plate and the second nozzle plate to allow a first surface of the receiver to receive fluid drops ejected from the first set of fluid ejection nozzles and a second surface of the receiver to receive ink drops ejected from the second set of nozzles.

In yet another aspect, the present inventions relates to a method of fluid delivery, comprising:

ejecting first fluid drops from a first set of fluid ejection nozzles in a first nozzle plate of a first fluid ejection head;

ejecting second fluid drops from a second set of fluid ejection nozzles in a nozzle plate of a second fluid ejection head, wherein the second nozzle plate is substantially opposing to the first nozzle plate and the second set of fluid ejection nozzles are offset from the first set of fluid ejection nozzles;

transporting a receiver a gap between the first fluid ejection head and the second fluid ejection head;

depositing the first fluid drops ejected on a first surface of the receiver; and depositing the second fluid drops on a second surface of the receiver.

Implementations of the system may include one or more of the following. A fluid ejection system includes a first fluid ejection head comprising a first nozzle plate that includes a first set of fluid ejection nozzles capable of ejecting first fluid drops and a second fluid ejection head comprising a second nozzle plate that includes a second set of fluid ejection nozzles capable of ejecting second fluid drops. The second nozzle plate is substantially opposing to the first nozzle plate. The first set of fluid ejection nozzles are offset from the second set of fluid ejection nozzles. The first set of fluid ejection nozzles span a first region and the second set of fluid ejection nozzles can span a second region that is substantially similar to the first region. The first fluid drops can be captured by the second nozzle plate in areas outside of the second set of fluid ejection nozzles and within the second region. The fluid drops captured by the second nozzle plate can be drawn into one or more of the second set of fluid ejection nozzles. The fluid ejection system can further include a receiver transport system configured to transport a receiver through a gap between the first fluid ejection head and the second fluid ejection head such that the first fluid ejection head can deposit the first fluid drops on a first surface of the receiver and the second fluid ejection head can deposit second fluid drops at a second surface of the receiver. The receiver transport system can transport the receiver in a first direction that is substantially parallel to the first nozzle plate or the second nozzle plate. The first fluid ejection head can produce a first fluid pattern on the first surface of the receiver and the second fluid ejection head produces on the second surface of the receiver a second fluid pattern that is a mirror image of the first fluid pattern. The first print head can deposit first fluid drops from edge to edge on the first surface of the receiver. The first set of fluid ejection nozzles can be distributed in one or more rows in the first nozzle plate such that the first print head can deposit first fluid drops across a first swath width on the first surface of the receiver. The first swath width can be wider than at least one of the dimensions of the first surface of the receiver. The first fluid ejection head can be an ink jet print head.

Implementations of the system may include one or more of the following. A duplex ink jet printing system includes a first ink jet print head comprising a first nozzle plate that includes a first set of nozzles capable of ejecting first ink drops, a second ink jet print head comprising a second nozzle plate that includes a second set of nozzles capable of ejecting second ink drops, wherein the second nozzle plate is substantially opposing to the first nozzle plate and the second set of nozzles in the first nozzle plate offset from the first set of nozzles in the second nozzle plate, and a receiver transport system configured to transport a receiver through a gap between the first nozzle plate and the second nozzle plate to allow a first surface of the receiver to receive fluid drops ejected from the first set of fluid ejection nozzles and a second surface of the receiver to receive ink drops ejected from the second set of nozzles. The first set of nozzles span a first region and the second set of nozzles can span a second region that is substantially similar to the first region. The first ink drops can be captured by the second nozzle plate in areas of outside of the second set of nozzles and within the second region. The first ink drops that fly outside the edges of the first surface of the receiver can be captured by the second nozzle plate in areas of outside of the second set of nozzles and within the second region. The ink drops captured by the second nozzle plate can be drawn into one or more of the second set of nozzles. The first set of nozzles formed in the first nozzle plate can be configured to deposit ink drops from edge to edge on the first surface of the receiver. The first ink jet print head can produce a first ink pattern on the first surface of the receiver and the second ink jet print head can produce on the second surface of the receiver a mirror image of the first ink pattern.

Embodiments may include one or more of the following advantages. The disclosed ink jet system is capable of duplex printing edge to edge on an ink receiver. The system is especially beneficial to handling narrow ink receivers. The disclosed ink jet system is compatible with fast drying inks, which together with duplex mode provides high printing throughput. The system provides effective nozzle maintenance and ink recycling capabilities, which reduces ink waste and further improves operation cycle and system throughput.

The details of one or more embodiments are set forth in the accompanying drawing and in the description below. Other features, objects, and advantages of the invention will become apparent from the description and drawings, and from the claims.

DETAILED DESCRIPTION

Figure 1:
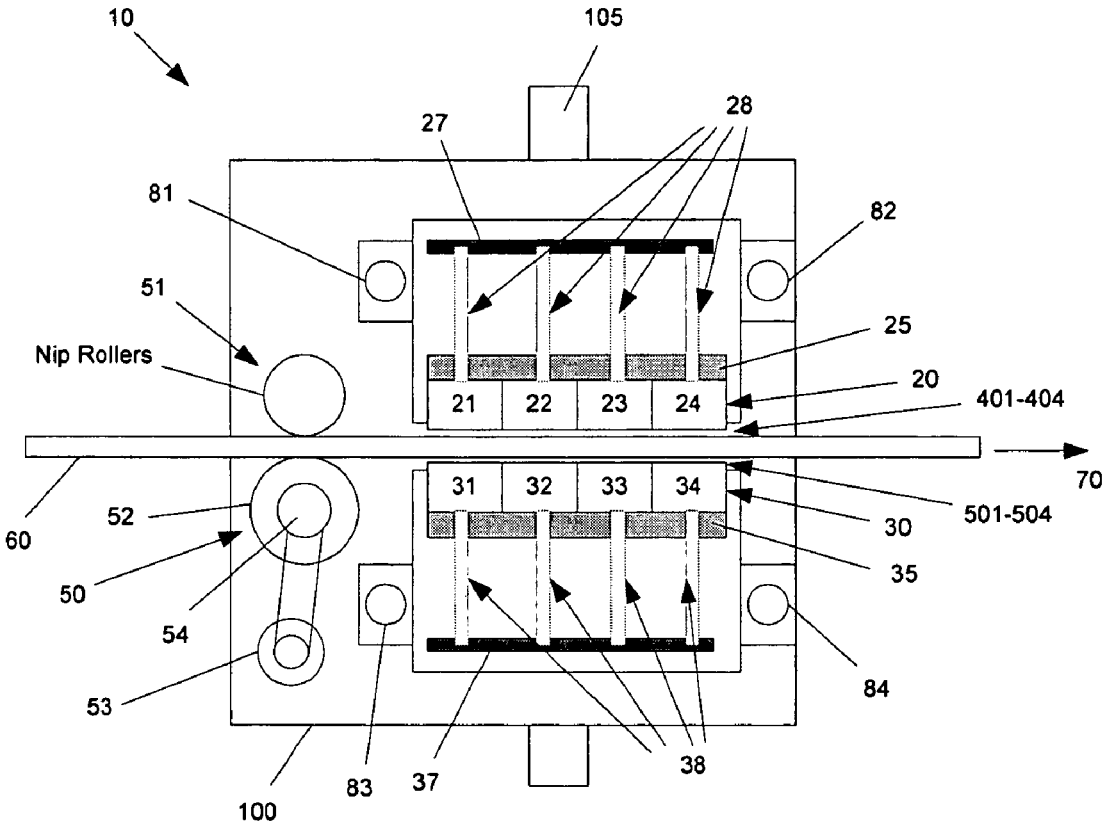
FIG. 1 shows partial view of a duplex ink jet printing system when viewed in front of a mount plate.
Figure 2:
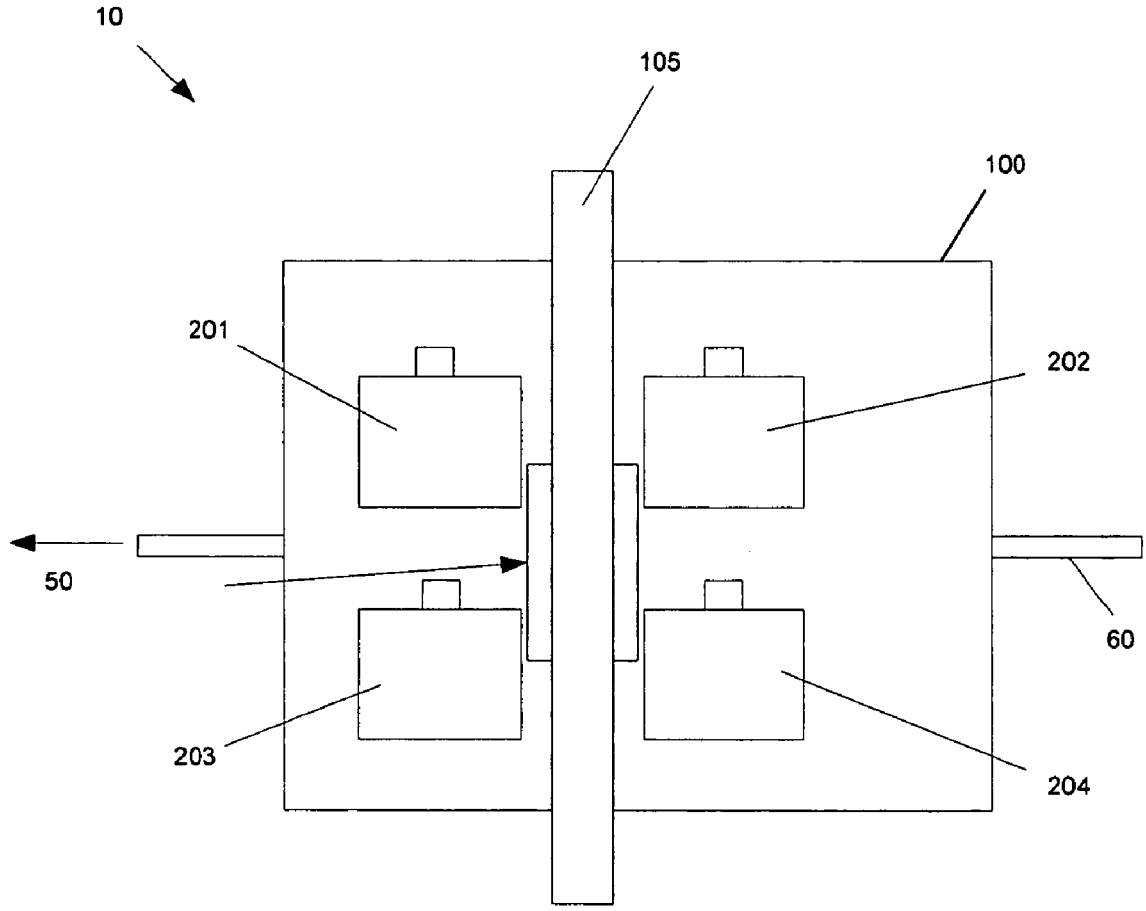
FIG. 2 is a partial view of the duplex ink jet printing system of FIG. 1 when viewed from the back of the mount plate.
Figure 3:
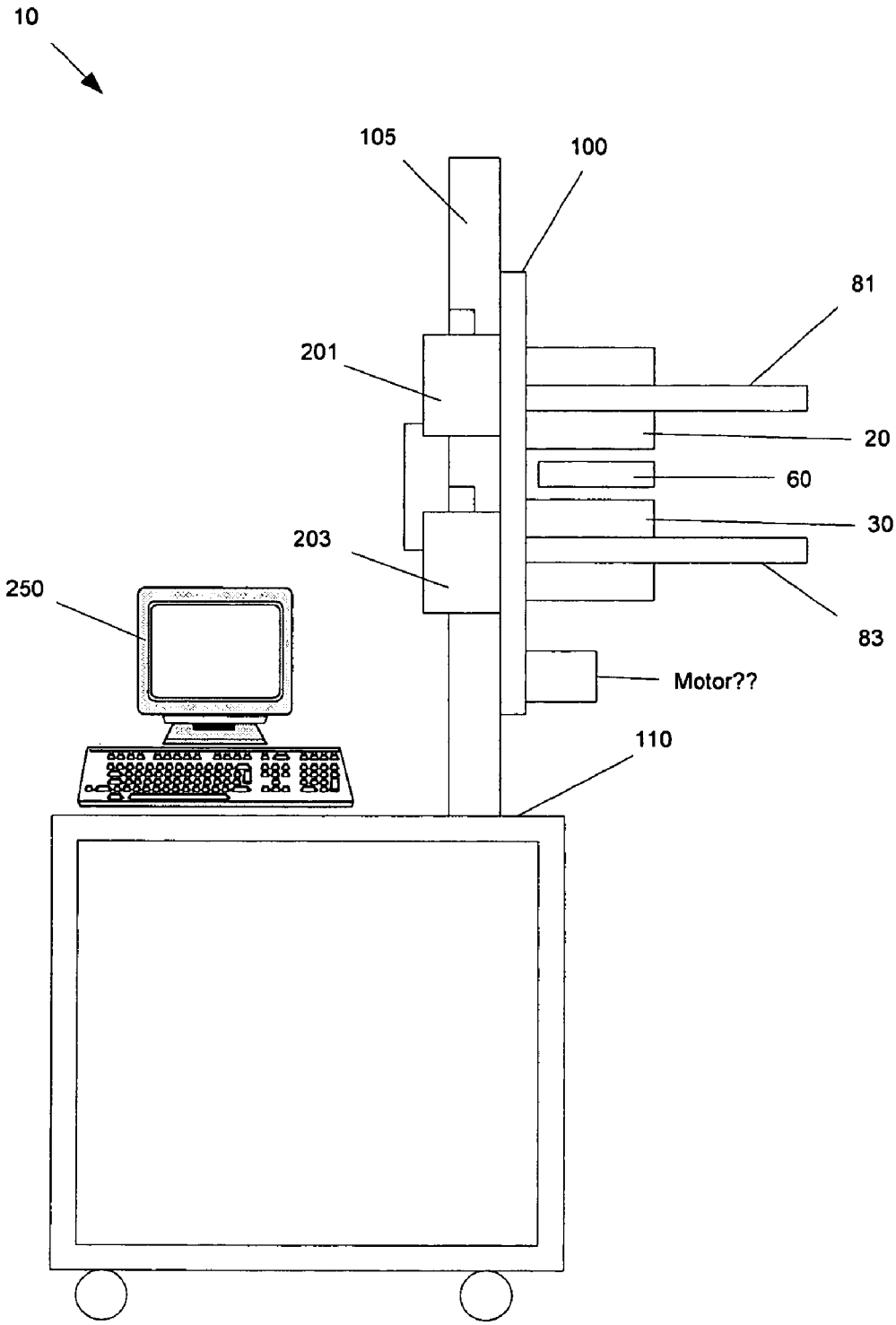
FIG. 3 is a side view of the duplex ink jet printing system of FIG. 1.

Shown in FIGS. 1-3, the duplex ink jet printing system 10 includes various components mounted to a mount plate 100 supported by a mount pole 105 that is fixed to a platform 110. A first ink jet print head assembly 20, a second ink jet print head assembly 30, and ink-receiver transport system 50 are held to the front of the mount plate 100. Ink reservoirs 201-204 are mounted to the back of the mount plate 100.

Referring to FIGS. 1-4, the first ink jet print head assembly 20 includes ink jet print heads 21-24 and ink manifold 25. The ink jet print heads 21-24 receive ink fluid from the ink manifold 25 that in turn receives inks from ink reservoirs 201, 202. Ink jet print heads 21-24 are controlled electronically by computer 250 through interface board 27 and flex prints 28. Ink jet print heads 21-24 can include ink ejection actuators and nozzle plates 401-404 that face downward. Each of the nozzle plates 401-404 comprises a plurality of ink nozzles 421-424 that can eject ink drops downward. Each set of ink nozzles 421-424 can be distributed in one or more rows such that the ink nozzles 421-424 can dispose ink drops spanning a first swath width SW1 on a receiver. The ink jet print heads 21-24 can be supplied with different colored ink fluids to provide color ink jet printing. Furthermore, two or more of the ink jet print heads 21-24 can be supplied with the same colored ink fluid and the corresponding ink nozzles 421-424 can be distributed in offset positions to provide high resolution ink jet printing.

Similarly, as shown in FIGS. 1-3 and 5, the second ink jet print head assembly 30 includes ink jet print heads 31-34 receiving inks from ink plate 35 that in turn receive inks from ink reservoirs 203,204. Ink jet print heads 31-34 are controlled electronically by computer 250 through interface board 37 and flex prints 38. Ink jet print heads 31-34 respectively comprise ink actuators and nozzle plates 501-504 that face upward. Each of the nozzle plates 501-504 comprises a plurality of ink nozzles 521-524 that can eject ink drops upward. Each set of ink nozzles 521-524 can be distributed in one or more rows that can print ink pattern on a receiver spanning a second swath width SW2. The ink jet print heads 31-34 can be supplied with different colored ink fluids to provide color ink jet printing. Furthermore, two or more of the ink jet print heads 31-34 can be supplied with the same colored ink fluid and the corresponding ink nozzles 521-524 can be distributed in offset positions to provide high resolution ink jet printing.

In one embodiment, ink jet print heads 21-24 and ink jet print heads 31-34 are oppositely disposed such that nozzle plates 401-404 and nozzle plates 501-504 are substantially opposite and parallel to each other (FIGS. 6 and 1) such that the first ink jet print head assembly 20 and the second ink jet receiver assembly 30 print on opposite surfaces of the receiver. Thus, the first and second ink jet assemblies can print on opposite surfaces of the receiver simultaneously. Ink nozzles 521-524 can eject ink drops toward nozzle plates 401-404. Similarly, ink nozzles 421-424 can eject ink drops toward nozzle plates 501-504. The gap between the substantially parallel nozzle plates 401-404 and nozzle plates 501-504 can be adjusted in response to the thickness of ink receiver 60. The gap is typically in the range of 0.2 to 2.0 cm plus the thickness of the receiver 60.

Figure 4:
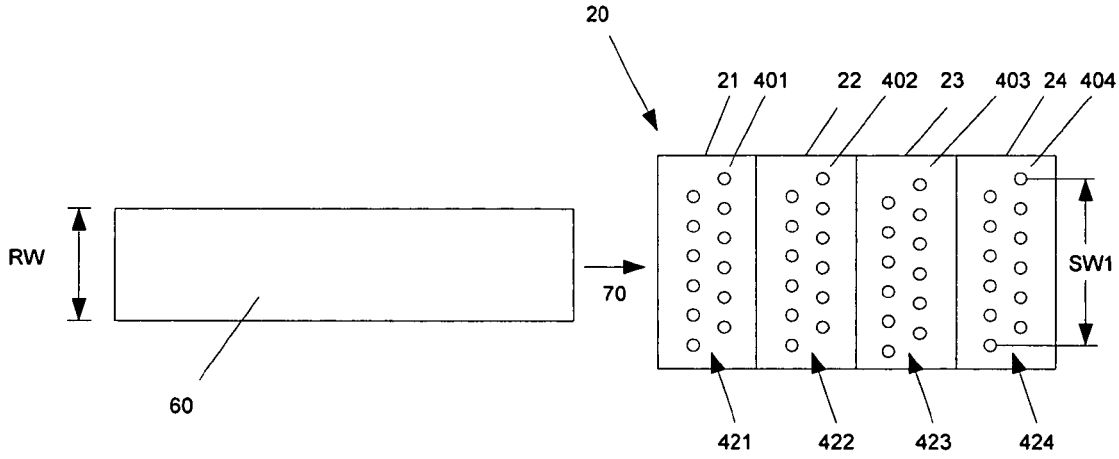
FIG. 4 is a top view of the ink nozzles and nozzle plate of the first ink jet print head assembly.
Figure 5:
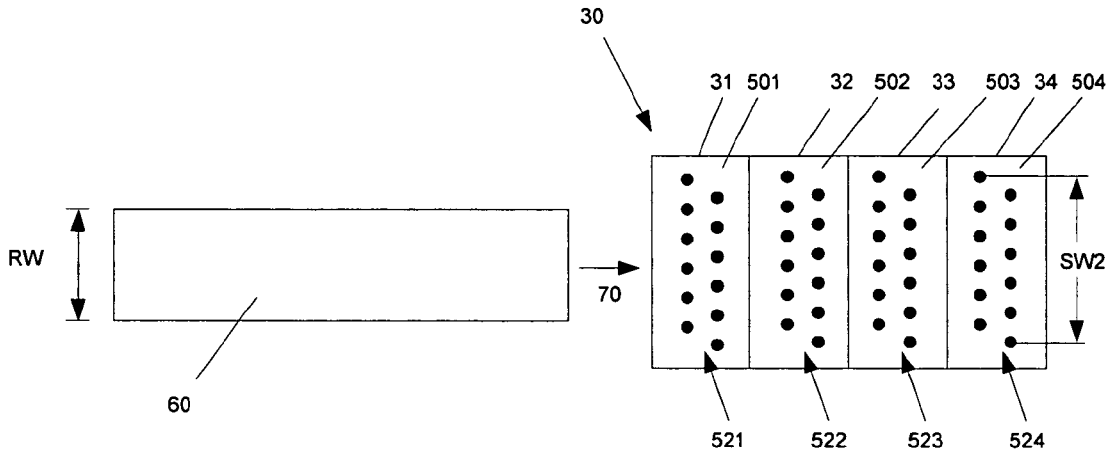
FIG. 5 is a top view of the ink nozzles and nozzle plate of the second ink jet print head assembly.
Figure 6:
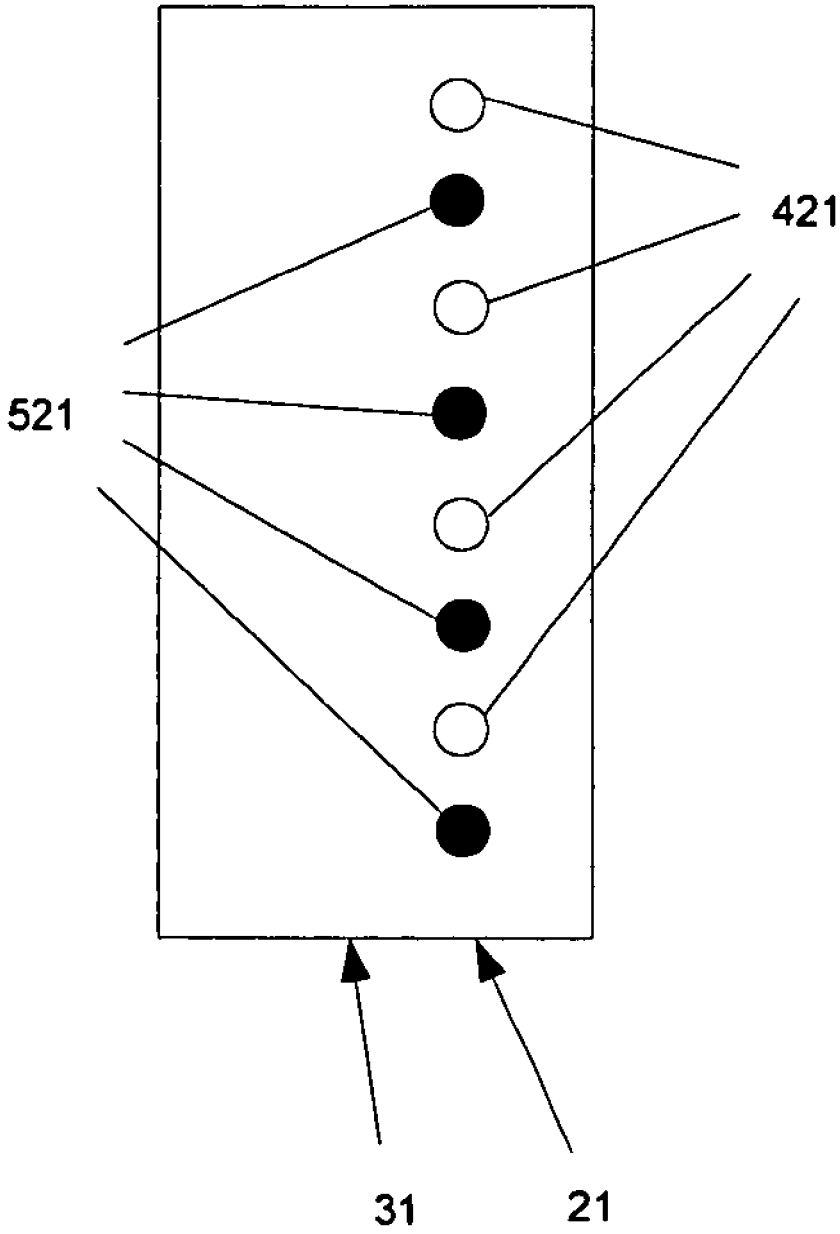
FIG. 6 is a partial projection top view of the positions of the ink nozzles of an ink jet print head from the first ink jet print head assembly relative to the positions of the ink nozzles of an ink jet print head from the second ink jet print head assembly.

As shown in the top views of FIGS. 4-6, the ink nozzles 421-424 and ink nozzles 521-524 are offset in their lateral positions. In other words, the ink nozzles 421-424 and ink nozzles 521-524 are not directly opposite to each other. For example, the ink nozzles 421-424 and ink nozzles 521-524 can be distributed in complimentary checkerboard patterns so each nozzle is pointing to the gap between nozzles in the opposing nozzle plate. Under this arrangement, ink drops ejected from ink nozzles 521-524 can be captured by the nozzle plates 401-404 in the areas outside of the ink nozzle 421-424. Similarly, ink drops ejected from ink nozzles 421-424 can be captured by the nozzle plates 501-504 in the areas outside of the ink nozzle 521-524. The ink drops ejected from a print head captured by the opposite nozzle plate therefore will not interfere with the drop ejection from the nozzle plate.

The first ink jet print head assembly 20 and the second ink jet print head assembly 30 are held to the mount plate 100 by slide bearing mechanisms 81-84. The lateral positions of ink jet print head assemblies 20 and 30 can be adjusted by slide bearing mechanisms 81-84 to allow the ink nozzles 421-424 on ink jet print heads 21-24 to be moved to positions offset and not directly opposing to the ink nozzles 521-524 on ink jet print heads 31-34. The inks supplied to ink jet print heads 21-24 and ink jet print heads 31-34 can be of different colors or different properties.

The ink receiver 60 can be driven by the transport system 50 in a direction 70 that can be perpendicular to the direction of transport of the print head assemblies by the slide bearing mechanisms 81-84. The transport system 50 includes a pair of nip rollers 51,52 that provides pressure contact to drive receiver 50. The rotations of the nip rollers 51,52 can be driven by a DC motor 53 under the control of computer 250. An encoder 54 tracks the rotation of the nip rollers and provides a feedback signal that can be used to control the DC motor 53 to ensure uniform motion of receiver 50. Although the receiver movement direction 70 and the nozzle plates 401-404,501-504 are shown to be horizontal in FIGS. 1-5, the system described is compatible with other orientation configurations. For example, the nozzle plates and the receiver motion can be parallel to the vertical direction.

In printing operation, ink receiver 60 is transported through the gap formed between nozzle plates 401-404 and nozzle plates 501-504. The ink nozzles 421-424 are adapted to eject and dispose ink droplets onto the top surface of the ink receiver 60. Similarly, ink nozzles 521-524 in nozzle plates 501-504 are adapted to eject and dispose ink drops onto the bottom surface of the ink receiver 50. In one embodiment (FIG. 4), the width of the receiver 50, RW, is narrower than at least one of the width of the first print swath SW1 or the second print swath width SW2, or narrower than both. Ink jet print heads 21-24 and ink jet print heads 31-34 can thus print edge to edge respectively on the top surface and the lower surface of the receiver 50. As a result, edge-to-edge duplex printing can be accomplished on receiver 60 when it is transported in direction 70.

The ejected ink droplets that have trajectory outside of the edges of the ink receiver 50 can be referred to as over-spray. In one embodiment, the over-spray can be captured by the nozzle plate of the opposing ink jet print head. The over-spray land at the areas of the opposing nozzle plate outside of the ink nozzles because the ink nozzles of the opposing nozzle plates are not directly opposite to each (FIGS. 4-6).

In one embodiment, the over-spray can accumulate on the opposing nozzle plate and is subsequently drawn into the ink nozzles. This reduces ink waste in normal edge-to-edge ink jet printing. No additional ink removal or cleaning is required on the opposing nozzle plate. Details of removing excessive ink on nozzles plate are disclosed in commonly assigned U.S. patent application Ser. No. 10/749,622 "Drop ejection assembly" by Barss et al, filed Dec. 30, 2003, commonly assigned U.S. patent application Ser. No. 10/749,829 "Drop ejection assembly" by Hoisington et al, filed Dec. 30, 2003, commonly assigned U.S. patent application Ser. No. 10/749,816 "Drop ejection assembly" by Bibl et al, filed Dec. 30, 2003, and commonly assigned U.S. patent application Ser. No. 10/749,816 "Drop ejection assembly" by Batterton et al, filed Dec. 30, 2003, the disclosure of which are incorporated herein by reference.

The described system is beneficial to duplex printing on narrow ink receivers such as wood slats for blinds and connector pins for masking. In printing such narrow ink receivers, it is difficult to size the image and guide the ink receiver to achieve the edge-to-edge coverage. Conventionally, over-sprays that miss the narrow ink receiver need to be removed. The described system overcomes both issues while providing duplex printing. The described system is compatible with ink receivers such as shaded blinds, faux wood laminates, and possibly masking connector pins. It will also be useful for backlit applications on translucent films.

In another embodiment, the proximity of nozzle plates 401-404 and nozzle plates 501-504 can produce a saturated vapor environment between the nozzle plates during printing. The high vapor concentration between the nozzle plates 401-404,501-504 and the receiver 60 reduce the rate of evaporation which enables the use of faster drying inks. The use of fast drying inks reduces image artifacts such as ink mottling and coalescence, which is beneficial to high throughput printing applications.

The first ink jet print head assembly 20 and the second ink jet print head assembly 30 can respectively receive mirror images of a same image from computer 250 so that symmetric image patterns can be printed on the top and the lower surfaces of ink receiver 60. Furthermore distinct images can also be printed on the top and the lower surfaces of ink receiver 60.

In another embodiment, during periods of non-printing, the ink jet print heads 21-24, and 31-34 can periodically fire ink drops at each other to maintain nozzles in wet states, which is especially useful to print heads comprising solvent based inks. As described above, the ink drops are captured by the opposing nozzle plates and sucked back into the ink nozzles. The mode of ink nozzle maintenance further reduces system down time and improves throughput of the duplex ink jet printing system.

Ink types compatible with the bulk degassing system include water-based inks, solvent-based inks, dye-based inks, pigment-based inks, and hot melt inks. The ink fluids may include colorants such as a dye or a pigment. Other fluids compatible with the system may include polymer solutions, gel solutions, solutions containing particles or low molecular-weight molecules.

What is claimed is:

1. A fluid ejection system, comprising:

a receiver transport system configured to transport a receiver having a maximum receiver width;

a first fluid ejection head comprising a first nozzle plate that includes a first set of fluid ejection nozzles capable of ejecting first fluid drops, the first set of fluid ejection nozzles spanning a first region, wherein the first region is greater than the maximum receiver width; and a second fluid ejection head comprising a second nozzle plate that includes a second set of fluid ejection nozzles capable of ejecting second fluid drops, wherein the second nozzle plate substantially opposes the first nozzle plate, and the first set of fluid ejection nozzles are offset from the second set of fluid ejection nozzles, and the second set of fluid ejection nozzles spans a second region, and the second nozzle plate is configured and positioned to capture the first fluid drops in areas outside of the second set of fluid ejection nozzles and within the second region.

2. The fluid ejection system of claim 1, wherein the second region is substantially similar to the first region.

3. The fluid ejection system of claim 1, wherein the second nozzle plate is configured to draw the first fluid drops that are captured by the second nozzle plate into one or more of the second set of fluid ejection nozzles.

4. The fluid ejection system of claim 1, wherein the first fluid ejection head is configured to deposit the first fluid drops on a first surface of the receiver and the second fluid ejection head is configured to deposit the second fluid drops on a second surface of the receiver.

5. The fluid ejection system of claim 1, wherein the receiver transport system transports the receiver in a first direction that is substantially parallel to the first nozzle plate or the second nozzle plate.

6. The fluid ejection system of claim 1, further comprising a controller configured to cause the first fluid ejection head to produce a first fluid pattern on the first surface of the receiver and the second fluid ejection head to produce on the second surface of the receiver a second fluid pattern that is a mirror image of the first fluid pattern.

7. The fluid ejection system of claim 1, wherein the first fluid ejection head is configured to deposit first fluid drops from edge to edge on the first surface of the receiver.

8. The fluid ejection system of claim 1, wherein the first set of fluid ejection nozzles are distributed in one or more rows in the first nozzle plate such that the first fluid ejection head is configured to deposit first fluid drops across a first swath width on the first surface of the receiver.

9. The fluid ejection system of claim 8, wherein the first swath width is wider than the maximum receiver width.

10. The fluid ejection system of claim 1, wherein the first fluid ejection head is an ink jet print head.

11. The system of claim 1, wherein the first fluid ejection head is a stationary fluid ejection head.

12. A duplex ink jet printing system, comprising:

a receiver transport system configured to transport a receiver in a first direction;

a first ink jet print head comprising a first nozzle plate that includes a first set of ink nozzles configured to deposit ink drops on a first surface of the receiver; and a second ink jet print head comprising a second nozzle plate that includes a second set of ink nozzles configured to deposit ink drops on a second surface of the receiver, wherein the second nozzle plate is configured to capture the first fluid drops in areas outside of the second set of fluid ejection nozzles, the second nozzle plate is substantially opposing the first nozzle plate and the second set of ink nozzles in the second nozzle plate are offset from the first set of ink nozzles in the first nozzle plate.

13. A method of fluid delivery, comprising:

ejecting first fluid drops from a first set of fluid ejection nozzles in a first nozzle plate of a first fluid ejection head, the first set of fluid ejection nozzles spanning a first region;

ejecting second fluid drops from a second set of fluid ejection nozzles in a nozzle plate of a second fluid ejection head, wherein the second set of fluid ejection nozzles span a second region, and the second nozzle plate is substantially opposing the first nozzle plate and the second set of fluid ejection nozzles are offset from the first set of fluid ejection nozzles;

transporting a receiver through a gap between the first fluid ejection head and the second fluid ejection head;

depositing the first fluid drops ejected on a first surface of the receiver;

depositing the second fluid drops on a second surface of the receiver; and capturing the first fluid drops with the second nozzle plate in areas outside of the second set of fluid ejection nozzles and within the second region.

14. The method of claim 13, wherein the second region is substantially similar to the first region.

15. The method of claim 14, further comprising capturing the first fluid drops that fly outside of the first surface of the receiver by the second nozzle plate in areas outside of the second set of fluid ejection nozzles and within the second region.

16. The method of claim 13, further comprising drawing the first fluid drops captured by the second nozzle plate into one or more of the second set of fluid ejection nozzles.

17. The method of claim 13, wherein transporting the receiver includes transporting the receiver in a direction that is substantially parallel to the first nozzle plate or the second nozzle plate.

18. The method of claim 13, wherein the first set of fluid ejection nozzles are disposed in the first nozzle plate in one or more rows that can eject fluid drops across a first swath width that is wider than at least one of the dimensions of the first surface of the receiver.

19. The method of claim 13, wherein depositing the first fluid drops includes depositing the first fluid drops from edge to edge on the first surface of the receiver.

20. The method of claim 19, wherein depositing the second fluid drops includes depositing the second fluid drops from edge to edge on the second surface of the receiver.

21. The method of claim 13, wherein the first surface and the second surface of the receiver are on opposite sides of the receiver.

22. The method of claim 13, wherein the fluid drops disposed on the first surface of the receiver form a first image pattern and the fluid drops printed on the second surface of the receiver form a mirror image of the first image pattern.

23. The method of claim 13, wherein the first fluid ejection head is an ink jet print head.

24. The method of claim 13, wherein the first fluid ejection head is held stationary while depositing the first fluid drops.

* * * * *